US010386056B2

(12) United States Patent
Schmidt et al.

(10) Patent No.: US 10,386,056 B2
(45) Date of Patent: Aug. 20, 2019

(54) ILLUMINANT WITH LEDS

(71) Applicant: OSRAM GmbH, Munich (DE)

(72) Inventors: Tobias Schmidt, Garching (DE); Krister Bergenek, Regensburg (DE); Frank Vollkommer, Gauting (DE); Philipp Erhard, Mering (DE); Andreas Kloss, Neubiberg (DE)

(73) Assignee: LEDVANCE GMBH, Garching Bei München (DE)

( * ) Notice: Subject to any disclaimer, the term of this patent is extended or adjusted under 35 U.S.C. 154(b) by 135 days.

(21) Appl. No.: 15/251,041

(22) Filed: Aug. 30, 2016

(65) Prior Publication Data

US 2017/0059147 A1 Mar. 2, 2017

(30) Foreign Application Priority Data

Sep. 1, 2015 (DE) ..... 10 2015 216 662

(51) Int. Cl.

| | |
|---|---|
| ***F21V 29/85*** | (2015.01) |
| ***F21V 29/70*** | (2015.01) |
| ***F21V 3/02*** | (2006.01) |
| ***F21V 7/04*** | (2006.01) |
| ***F21V 17/16*** | (2006.01) |
| ***F21V 23/00*** | (2015.01) |
| ***F21V 7/22*** | (2018.01) |

(Continued)

(52) U.S. Cl.

CPC ..... *F21V 29/70* (2015.01); *F21K 9/233* (2016.08); *F21V 3/02* (2013.01); *F21V 7/04* (2013.01); *F21V 7/22* (2013.01); *F21V 17/166* (2013.01); *F21V 23/005* (2013.01); *F21V 23/006* (2013.01); *F21K 9/238* (2016.08); *F21K 9/68* (2016.08); *F21K 9/69* (2016.08); *F21V 5/004* (2013.01); *F21V 7/048* (2013.01); *F21V 29/85* (2015.01); *F21V 29/89* (2015.01); *F21Y 2107/90* (2016.08); *F21Y 2115/10* (2016.08)

(58) Field of Classification Search

CPC ... F21V 29/70; F21V 3/02; F21V 7/04; F21V 7/22; F21V 23/005; F21V 23/006; F21K 9/233

See application file for complete search history.

(56) References Cited

U.S. PATENT DOCUMENTS

2006/0209513 A1* 9/2006 Gruendler ..... H01L 23/4093 361/704
2010/0164349 A1* 7/2010 Kazmierski ..... F21V 13/04 313/111

(Continued)

FOREIGN PATENT DOCUMENTS

CN 101858507 A 10/2010
WO 2012055091 A1 5/2012

*Primary Examiner* — Anh T Mai
*Assistant Examiner* — Nathaniel J Lee
(74) *Attorney, Agent, or Firm* — Hayes Soloway PC

(57) ABSTRACT

An illuminant with at least two LEDs mounted on mutually opposite sides of a support plate and a reflection surface formed as a concave mirror, in which concave mirror the LEDs are arranged, wherein a housing part of the illuminant made of a transparent housing material is provided, which housing part at the same time forms an in relation to the main propagation direction lateral external surface of the illuminant and supports a reflecting layer forming the reflection surface at an internal surface opposite to the external surface.

20 Claims, 5 Drawing Sheets

(51) Int. Cl.

| | |
|---|---|
| ***F21K 9/233*** | (2016.01) |
| *F21K 9/68* | (2016.01) |
| *F21V 29/89* | (2015.01) |
| *F21Y 115/10* | (2016.01) |
| *F21V 5/00* | (2018.01) |
| *F21K 9/238* | (2016.01) |
| *F21K 9/69* | (2016.01) |
| *F21Y 107/90* | (2016.01) |

(56) References Cited

U.S. PATENT DOCUMENTS

| | | | | |
|---|---|---|---|---|
| 2011/0074296 | A1 | 3/2011 | Shen et al. | |
| 2012/0002423 | A1 | 1/2012 | Li et al. | |
| 2012/0014107 | A1 | 1/2012 | Avila | |
| 2012/0230028 | A1 | 9/2012 | Foo | |
| 2014/0191647 | A1 | 7/2014 | Ter Weeme et al. | |
| 2014/0376238 | A1* | 12/2014 | Kadijk | F21V 23/006 362/382 |
| 2015/0103538 | A1* | 4/2015 | Marinus | F21K 9/90 362/373 |

* cited by examiner

ILLUMINANT WITH LEDS

CROSS-REFERENCE TO RELATED APPLICATION(S)

This patent application claims the benefit under 35 U.S.C. § 119 to German Patent Application No. 10 2015 216 662.7, filed on Sep. 1, 2015, the entirety of which is incorporated herein by reference.

TECHNICAL FIELD

The present invention relates to an illuminant with LEDs mounted on a support plate, wherein the illuminant is intended to emit light substantially in a bundled manner.

PRIOR ART

For example, the illuminant in question can be used for spot lighting, thus for a spatially concentrated illumination, in particular as a substitute for classical halogen reflector lamps. With such an illuminant emitting light in a directed manner, the adjustment requirements for integrating LEDs, where appropriate, may a priori be less than in case of an illuminant with a principally omnidirectional radiation characteristic such as a light bulb substitute.

Namely, an LED by itself already has a directed, typically Lambertian radiation characteristic which can comparatively easily be converted into a cone-shaped spot lighting by means of a convex or converging lens, for example. Thereby, a scalability concerning the desired light flux exists, in particular in connection with the required cooling; namely, a plurality of LEDs can be placed side by side on a cooling element and the light emitted therefrom can then be bundled, for example by means of a common converging lens.

DESCRIPTION OF THE INVENTION

The present invention is based on the technical problem of providing an LED-fitted illuminant with directed radiation characteristics, which is advantageous compared to prior art.

According to the invention this object is achieved by an illuminant comprising a first LED and a second LED for emitting light, a planar support plate on which the LEDs are mounted, a reflection surface shaped as a concave mirror, in which concave mirror the LEDs mounted on the support plate are arranged, so that in operation at least a portion of the light emitted therefrom is reflected by the reflection surface and thereby bundled with a main propagation direction, a base connection to which the LEDs are connected in an electrically operable manner for electrically contacting the illuminant from outside, wherein a direction of one surface of the support plate is aligned along the main propagation direction, and wherein the first LED is mounted on a first side of the support plate and the second LED is mounted on a second side of the support plate opposite thereto in relation to a thickness direction of the support plate, and wherein a housing part of the illuminant made of a transparent housing material is provided, which housing part at the same time forms an external surface of the illuminant, the external surface flanking the main propagation direction and supporting a reflecting layer which forms the reflection surface at an internal surface opposite to the external surface.

Preferred embodiments can be found in the dependent claims and the remaining specification, wherein in the representation of the features it is not always distinguished in detail between device aspects and method aspects or rather usage aspects; in any case the disclosure is to be read concerning all claim categories implicitly.

So, in the illuminant according to the invention a support plate fitted with LEDs on both sides is at first provided, whereby solely considering the support plate not only a half-space, but due to the arrangement also the opposite half-space is provided with LED light. Then, at least a portion of the light is directed over the reflection surface shaped as a concave mirror for bundling. Thereby, the reflecting layer forming this reflection surface is supported by the housing part which at the same time and by the same token forms the lateral external surface of the illuminant, resulting in an overall comparatively simple structure.

The inventors have determined that an especially interesting interaction can result if the reflecting layer is not completely reflective, but for example formed as a dichroic layer with a certain transmissivity. Then, not the total light emitted by the LEDs is reflected and bundled, but a rather smaller portion (i.e., not more than 10% or rather 5%) can shimmer through the reflecting layer and then also through the transparent housing part. On the one hand, this can be optically attractive, whereas on the other hand losses in the light yield can be kept manageable by using LEDs. Thereby, the reflection surface can be illuminated in a comparatively homogeneous manner by means of the LEDs already emitting in two opposite half-spaces due to the arrangement, whereby a relatively uniform shimmering through can be achieved. In summary, the combination of features according to main claims may at first appear somewhat more elaborate, where appropriate, than the version "LED with converging lens" mentioned at the beginning, but it opens up interesting configuration options. The portion of the light shimmering through can, to some extent, form a background lighting and thus help to prevent too strong contrasts and glaring, for example.

The "flanking" external surface formed by the housing part is a visible external surface facing the illuminant and perpendicular to the main propagation direction. This extends in the main propagation direction preferably at least over the total reflecting layer, further preferred beyond it. With regard to a maximum overall length of the illuminant, taken in the main propagation direction, the external surface formed by the housing part may for example extend over at least 30%, 40%, 50%, 60% or rather 70% (increasingly preferred in the order given) of the overall length, wherein possible upper limits may be at at most 90% or rather 80%, for example. In case a length of the external surface varies across a revolution around the main propagation direction, a mean value thereof formed over the revolution is considered.

The "main propagation direction" results as a mean value of all direction vectors, along which the light directed over the reflection surface is reflected, wherein with this mean value formation each direction vector is weighted with the light intensity associated therewith. Thus, the overall portion of the light emitted by the LEDs and then directed over the reflection surface is considered here. Terms as "ahead or in front" and "behind or rear" refer to the main propagation direction; the side directions ("flanking") are perpendicular to it.

The support plate with one of its surface directions which are all oriented perpendicular to the thickness direction of the support plate is intended to be aligned "along the main propagation direction", namely including an angle of, in the order of naming increasingly preferred, not more than 25°, 20°, 15°, 10° or rather 5°; particularly preferred, said surface direction of the support plate and the main propagation direction coincide. Here, that one of the surface directions which is at the smallest angle to the main propagation direction is considered, wherein it preferably is a matter of a surface direction parallel to two edge surfaces of the support plate.

The LEDs mounted on the support plate are arranged in the concave mirror, thus facing its in any case overall concavely curved reflection surface. In case that the reflection surface is preferably faceted, it can also locally (per facet) be planar or convex, for example. Insofar as the concave mirror in preferred embodiments has a focus (which is not necessarily the case in general), an arrangement of LED/LEDs close to or in the focus may be preferred. A front outlet side of the concave mirror is preferably closed by a transparent or translucent covering disc, particularly preferred by a planar covering disc; therefore, the support plate with the LEDs is shifted correspondingly far rearward.

The base connection is preferably provided at the rear end of the illuminant, thus opposite to the preferred covering disc; a base connection according to the Bipin Foot Standardization, such as of type GU4, GU5.3 or GU10, is preferred.

Preferably, the illuminant is designed for emitting light with a light flux of at least 200 lm, preferably at least 300 lm and (notwithstanding the above) of not more than 600 lm or rather 500 lm, for example. By way of example in the order of naming increasingly preferred, at least 30%, 40%, 50% or rather 60% of the light emitted by the LEDs shall be directed over the reflection surface, wherein merely due to the arrangement possible upper limits may be at most 90% or rather 80%, for example. Statements regarding portions of light generally relate to the light flux within the scope of this disclosure.

Preferably, the light entirely emitted by the illuminant and at least partially formed by the reflected light has a radiation angle, taken according to the full width half maximum, of at most 70°, in the order of naming increasingly preferred, at most 65°, 60°, 55°, 50° or rather 45°, wherein (notwithstanding the above) possible lower limits are at least 10°, 15° or rather 20°, for example. In case a radiation angle varies across a revolution, a mean value formed over the revolution is considered here.

The LEDs "mounted" on the support plate are preferably soldered on, wherein at least some of the solder connections at the same time provide the electrical contact between a conducting path structure and the respective LED and serve for mechanically fixing the LED (but additionally solder connections merely serving for mechanically fixing/thermally connecting can also be provided). Encased LED chips, especially preferred so-called SMD elements (surface mounted device), are preferred as LEDs, which can be soldered on in a reflow process. The illuminant can be electrically connected through the base (from outside in the application).

The "planar or two-dimensional" support plate has a smaller extension (thickness) in its thickness direction than in the surface directions perpendicular thereto. In each of the surface directions in which the length and the width of the support plate are also taken, the extension of the support plate should correspond to, i.e., at least 5-, 10-, 15- or rather 20-times the thickness, wherein a thickness averaged over the support plate is considered. In relation to the thickness direction the "mutually opposite sides" of the support plate are opposite to each other and are also designated as "side surfaces" of the support plate (which are connected with each other by one or more edge surfaces of the support plate extending in thickness direction). The LEDs are mounted on the side surfaces extending in the surface directions (no LEDs are provided on the edge surfaces; therefore they are devoid of LEDs).

On each side (side surface) of the support plate at least one LED is provided, wherein at least two LEDs per side may be preferred; for example, possible upper limits may be at most four or rather at most three LEDs per side, wherein exactly two LEDs per side are particularly preferred. The first and the second LED mounted on the mutually opposite sides are preferably arranged such that their LED main propagation directions are exactly mutually opposite (including an angle of 180° between them). A respective "LED main propagation direction" results as a mean value of all direction vectors weighted according to light intensity (for this purpose, also compare the remarks to "main propagation direction") along which the respective LED emits light. If a plurality of LEDs is arranged on a side of the support plate, their LED main propagation directions preferably coincide (they include an angle of 0°.

In a preferred embodiment the housing material is glass. For example, for thermal reasons this may offer an advantage compared to a generally also possible plastic material such as polycarbonate. For example, the glass can also be optically more stable, therefore, where appropriate, less susceptible to hazing or the like. For instance, then a shimmering through as described earlier thus retains the same impression even over the lifetime which is usually significantly extended by using LEDs.

As already mentioned, in a preferred configuration the reflecting layer is a dichroic layer. But in general, also a metallic reflecting layer such as an aluminum layer is possible. Therefore, the option of shimmering through mentioned at the beginning should at first illustrate a possibility opened up with the feature combination according to main claims, but not limit the subject-matter in its generality. Generally, the reflecting layer preferably is a layer deposited onto the housing part, commonly also by an immersion method, preferably from the gas phase. Generally, a layer between the reflecting layer and the housing part can also be provided, such as for providing adhesion; preferably, the reflecting layer directly adjoins the housing material. The reflecting layer can also be covered by a transparent protection layer, i.e. made of silicon oxide, which may also be applied for example by means of an immersion method or from the gas phase. Irrespective of the material of the reflecting layer, a faceted reflection surface can be preferred.

In a preferred embodiment the support plate is a circuit board with a conducting path structure, with which the LEDs are electrically conductively connected. Then the conducting path structure for its part is connected to the base connection, which can generally also be performed by an interposed driver electronics.

In a preferred configuration, at least parts of a or rather the complete driver electronics is preferably mounted together with the LEDs on the same circuit board. The connection to the base connection can be implemented for example by means of wires electrically conductively connected, i.e. soldered on, to the conducting path structure. Preferably, the circuit board is the only circuit board of the illuminant, which may help in simplifying the logistics and/or the assembling in the production, for example.

In a preferred embodiment the support plate preferably provided as a circuit board comprises a metal layer with an area, taken in the surface directions of the support plate, of at least 20 $mm^2$, in the order of naming increasingly preferred, at least 30 $mm^2$, 40 $mm^2$, 50 $mm^2$, 60 $mm^2$, 70 $mm^2$, 80 $mm^2$, 90 $mm^2$ or rather 100 $mm^2$. Notwithstanding the above, possible upper limits can be for example at at most 250 $mm^2$, preferably at most 225 $mm^2$, especially preferred at most 200 $mm^2$. The area preferably relates to a completely continuous metal layer, which may help in optimizing the desired heat spreading.

In the direction of thickness the metal layer has preferably a thickness of at least 35 μm, in the order of naming increasingly preferred, at least 50 μm, 65 μm or rather 80 μm; (notwithstanding the above) possible upper limits for example are at at most 500 μm, 400 μm, 300 μm, 200 μm, 150 μm or rather 100 μm. In case of a thickness varying across the support plate a mean value calculated over it is considered here.

Copper is preferred as a material for the metal layer. Generally, the circuit board can also be built up as a metal core board; thus the metal layer may be sandwiched between two insulating substrate layers of a multilayer substrate, on whose external lateral surfaces conductive paths for contacting the LEDs are then structured or patterned. Preferably, the metal layer is however arranged in a layer with conducting paths serving for electrically contacting the LEDs, and thereby it can also be provided for its part in an current-carrying manner (or rather provide an electrical potential). The metal layer is preferably covered with a layer of a dielectric material, which can for example have a thickness of at least 10 μm, preferably at least 20 μm and (notwithstanding the above) for example not more than 150 μm or rather 100 μm (generally a mean value calculated over the layer will again be considered as thickness). For example, a solder resist can be applied to the metal layer.

In general, the circuit board can also be provided with conducting paths only on one side, and the LED arranged on the other side may be contacted by through-connection, for example. However, a circuit board provided with conducting paths on both sides (at both lateral surfaces) is preferred. Furthermore, a respective metal layer with a minimum area substantiated before is then provided on each side, respectively in the layer with the conducting paths. In the case of the two metal layers each of them is preferably coated with a dielectric material (see above); therefore such a material is applied to both sides of the circuit board.

In a preferred embodiment a cooling element in direct thermal contact with both the support plate and the housing part is arranged between these two, whose thermal resistance from the support plate into the housing part (including the thermal contact resistances from support plate to cooling element and from cooling element to housing part) should be at most 45 K/W, in the order of naming increasingly preferred, at most 40 K/W, 35 K/W, 30 K/W, 25 K/W, 20 K/W or rather 15 K/W. Due to technical reasons a lower limit may be at 5 K/W, for example.

"In direct thermal contact" means for example directly adjoining, which is preferred in particular in the case of the interface to the housing part. But the direct thermal contact can also be formed by means of a solder or welding connection, particularly to the metal layer of the support plate discussed above, or also through an intermediate layer of good thermal conductivity such as of a so-called TIM (thermal interface material), which may also be configured self-adhesive, for example. But as already mentioned, a mere abutment can also provide the direct thermal contact, as well in the case of the interface between cooling element and support plate.

Irrespective of the type of connection in detail, for the contact surface between support plate and cooling element an area taken in the surface directions and, if appropriate, added up over the partial surfaces is preferred, which at least is as large as an area portion of the support plate fitted with LEDs. Therefore, the base areas of the LEDs arranged on the support plate are added up, and the contact area between cooling element and support plate should correspond to at least this added up area, preferably at least twice, further preferred at least the fourfold thereof. The "base area of an LED" is taken at a perpendicular projection of the LED in a plane perpendicular to the thickness direction of the support plate.

The, if appropriate, cumulative contact area which the support plate and cooling element present each other, can for example be, in the order of naming increasingly preferred, at least 10 $mm^2$, 10 $mm^2$, 20 $mm^2$, 30 $mm^2$, 40 $mm^2$ and 50 $mm^2$, respectively, wherein (notwithstanding the above) possible upper limits may for example be at most 400 $mm^2$, 300 $mm^2$, 200 $mm^2$ or rather 100 $mm^2$. The same values shall also be disclosed as preferred for the contact area between cooling element and housing part.

In a preferred embodiment the cooling element (thermally) contacts the mutually opposite sides of the support plate respectively with a spring, thus respectively with a certain contact pressure. Thereby, it may be preferred that the springs of the cooling element only abut against the support plate so that this is then held between the at least two springs exclusively in a friction-locked manner, which may for example simplify the assembling. Preferably, two springs of the cooling element contact the support plate per side of the support plate, thus four springs in total. Thereby, the two springs per side are preferably provided such that they together substantially enclose the LED(s) arranged on this side of the support plate (seen in a plan view to the respective support plate side).

In a preferred configuration the cooling element is composed of at least two parts, preferably exactly two parts, wherein the cooling element parts together enclose the support plate. In this context, "enclosing" does not necessarily mean completely surrounding towards the side, but refers to a cooling element arranged then on both sides of the support plate. Therefore, the cooling element consists of a number of cooling element parts which during production are still separated, but afterwards assembled. The cooling element parts are preferably assembled at the support plate such that at assembly the cooling element also already takes its position at the support plate (being arranged relative to it as well as to the illuminant).

The cooling elements parts can preferably be worked out of a surface material such as punched parts and be formed into their three-dimensional shape by bending. The assembled cooling element parts can preferably be held together in form-fitting manner; thus for example, they can directly interlock with each other and/or be held together by an optical body (see below).

In a preferred configuration a rear portion of the housing part, in relation to a revolution around the main propagation direction, confines a cavity, into which the cooling element is inserted, is preferably inserted opposite to the main propagation direction during manufacturing. The cooling element preferably has a certain oversize against the cavity and thus is then held therein in a force-fitting or friction-locked manner by means of an oversize fit. Preferably, the cooling element and the support plate enclosed thereby are held within the housing part exclusively in a friction-locked manner, which can, for example, simplify the assembling.

Viewed in sectional planes perpendicular to the main propagation direction, the cavity is preferably round, especially preferred circular; accordingly cooling element which is the inserted afterwards, viewed in these sectional planes, is also preferably round or rather circular and thus extensively abuts against an internal surface of the housing part confining the cavity. The rear portion of the housing part is preferably shaped as a hollow cylinder; also the part of the cooling element inserted into the cavity is preferably shaped as a hollow cylinder. In the main propagation direction then the springs thermally contacting the support plate follow the portion of the cooling element inserted into the cavity.

In the preferred case of a driver electronics partially/totally mounted together with the LEDs on the support plate, this is preferably arranged in a rear part of the support plate and arranged together with the rear part of the cooling element in the cavity.

In a preferred embodiment an optical body made of a transparent optical body material, preferably of a plastic material such as polycarbonate, polymethylmethacrylate or silicone, is placed at a front end of the support plate. At least a portion of the light emitted by the LEDs permeates the optical body without reflection, therefore without being reflected at the reflection surface previously or afterwards. The portion of the light permeating the optical body without reflection can for example account for at least 5%, preferably at least 10% and (notwithstanding the above) for example not more than 40% or rather 25% of the total light emitted by the LEDs mounted on the support plate.

In a preferred configuration the optical body acts as a converging lens, therefore bundles at least a portion of the light permeating it, such as at least 70%, 80% or rather 90% thereof (in the order to naming increasingly preferred), particularly preferred the total light. The optical body acting as a converging lens diffracts the light (a corresponding portion thereof) preferably into a target spatial angle region comprising all directions, which are tilted with respect to the main propagation direction by not more than 45°. The optical body acting as a converging lens can preferably have a planar-convex or concave-convex shape (in relation to the main propagation direction), at least in its region permeated by light.

In a preferred embodiment the optical body comprises a light mixing means, preferably in addition to the converging lens function. When viewing the illuminant from the main propagation direction, the light mixing means can for example cover at least the LEDs, preferably also the support plate, and can for example make them appear somewhat blurred, thus blurring. In general, the light mixing means can also be applied to the light ingress surface and/or the light emitting surface of the optical body as a separate coating, for example. But scattering or diffuser particles, i.e. made of titan dioxide, can also be embedded in the optical body material itself as light mixing means.

Preferably, the light mixing means is formed into the light ingress surface (facing the support plate) and/or the light emitting surface (facing away from the support plate) of the optical body; therefore its surface can be roughened, for example. Preferably, micro lenses are formed into at least one of the light transmission surfaces, preferably into the light emitting surface. The micro lenses could generally also be diverging or concave lenses; however, for manufacturing reasons converging micro lenses are also preferred. A beam bundle permeating the light transmission surface with the micro lenses is subdivided into a plurality of sub-beam bundles (one sub-beam bundle per micro lens).

Downstream the respective micro lens (downstream the respective focus plane with converging micro lenses) each of the sub-beam bundles is slightly widened, for example, by at least 2°, preferably at least 5°, wherein (notwithstanding the above) possible upper limits are for example at at most 30°, 25° or rather 20° (in the order of naming increasingly preferred); thereby the widening is determined by the opening angle determined according to the full width half maximum. Due to the widening the sub-beam bundles are then superimposed, and thus a homogenization of the light is achieved.

By way of example at least 20, preferably at least 50, particularly preferred at least 100 micro lenses can be formed into the corresponding light transmission surface (ingress or emitting surface), wherein (notwithstanding the above) possible upper limits are for example at most 5,000, 3,000 or rather 1,000 micro lenses. Micro lenses with a respectively separately spherically curved transmission surface are preferred.

In a preferred embodiment concerning a combination of optical body and cooling element, the optical body is interlocked with the support plate and/or preferably the cooling element. With this interlocked fit thus formed the optical body is securely held to prevent a lift-off along the main propagation direction (at least to some extent), thus fixed in position relative to the support plate and therewith to the LEDs. The interlocked fit is preferably provided between one projection each at each of the edge surfaces of the support plate extending along the main propagation direction and one corresponding recess in the optical body, respectively; the two projections protruding in opposite directions laterally outwards respectively engage in a recess. The projections are preferably formed by one groove each, completely going through the support plate in direction of the thickness, respectively.

Preferably, the recesses can respectively be provided in a side part of the optical body, wherein the side parts are respectively supported against the remaining optical body by a material bridge in an elastic, outwardly flexible manner; during the assembly of the optical body and the support plate they can temporarily be deflected outwards and then regain their original position in the interlocked fit.

In a preferred configuration the optical body in its interlocked fit preferably formed with the support plate presses the springs of the cooling element into their contact with, preferably their abutment against, the support plate. For this purpose, at least two bars are preferably formed at the light ingress surface of the optical body with which it abuts against the support plate and/or the cooling element, therefore on each side of the support plate at least one bar pressing the respective spring(s) onto the respective support plate side. Preferably, the bars are shaped from the same optical body material as the remaining optical body and formed monolithically therewith, thus apart from randomly distributed inclusions without any material boundary therebetween (between the bars and the remaining optical body). Generally, the optical body preferably is a molded part, in its form released by a molding tool, preferably an injection-molded part.

In a preferred embodiment a transverse reflector extending transversely, preferably perpendicular, to the main propagation direction is placed at the support plate. Preferably, it is arranged flush with a rearward edge of the reflection surface and/or covers a cavity (see above) in a rearward housing part in relation to a view to the illuminant opposite to the main propagation direction.

For fastening the transverse reflector the support plate and/or the reflector can for example be slotted and pushed together. By way of example, regarding the LED light (averaged over its spectral range) the transverse reflector should have a reflectance of at least 80%, preferably at least 90%, further preferred at least 95%, wherein (due to technical reasons) a possible upper limit may be at 99.9%, for example. A diffuse reflection is preferred.

Preferably, the transverse reflector is a, for its part, simply constructed part devoid of LEDs (on which no LED is arranged). Generally, the transverse reflector can also be constructed with a plurality of layers with a coating forming the reflecting surface; but preferably, the transverse reflector is a monolithic part (apart from, if appropriate, statistically distributed inclusions devoid of material boundaries inside), such as a metal plate or preferably a reflector made of a plastic material, in which reflecting particles and/or gas bubbles are embedded. The transverse reflector is preferably planar in total.

The invention also relates to a method for producing an illuminant disclosed above, wherein preferably at first the cooling element is mounted to the support plate and then the entirety of support plate with cooling element mounted thereto is inserted into the cavity in the rear portion of the housing part. Regarding further details of the method, the disclosure above is also explicitly referred to.

SHORT DESCRIPTION OF THE DRAWINGS

Hereafter the invention is explained in further detail on the basis of embodiments, wherein the individual features can also be relevant for the invention in another combination within the scope of the sub-claims, and furthermore it is also not distinguished in detail between the different claim categories.

In detail,

FIG. 1*a* shows a first illuminant according to the invention in an oblique front view;

FIG. 1*b* shows the illuminant according to FIG. 1*a* additionally with an optical body covering the support plate and LEDs;

FIG. 1*c* shows a schematic cross section through the illuminant according to FIG. 1*b;*

FIG. 2 shows another illuminant according to the invention differing from those according to FIGS. 1*b, c* in the configuration of the optical body;

FIG. 3*a* shows an LED-fitted support plate with the cooling element attached thereto as a light source of the illuminant according to FIGS. 1 and 2;

FIG. 3*b* shows a part of the cooling element according to FIG. 3*a;*

PREFERRED CONFIGURATION OF THE INVENTION

Figure 1A:
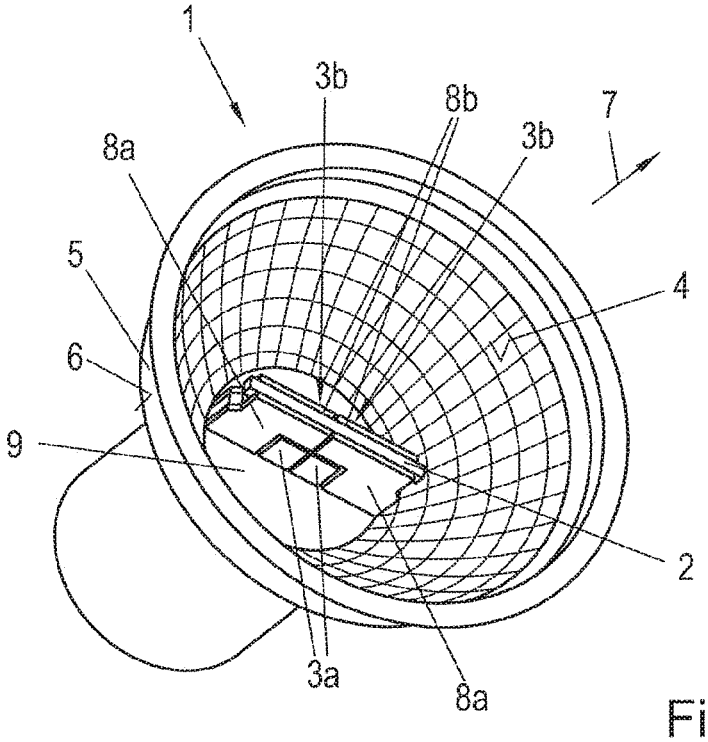

FIG. 1*a* shows a first illuminant 1 according to the invention with LEDs 3 mounted on a support plate 2. The support plate 2 is configured as a circuit board with a conducting path structure (not illustrated) by which the LEDs 3 are connected to a driver electronics and a base connection (c.f. FIG. 1*c*). The support plate 2 is fitted with LEDs 3*a* on a first side and with LEDs 3*b* (not visible) on the opposite side, namely with two LEDs 3 each on both sides.

The LEDs 3 are arranged in a concave mirror formed by a reflection surface 4; therefore a portion of the light emitted by the LEDs 3 is directed over the reflection surface 4 and thereby bundled. The reflection surface 4 is faceted, namely subdivided into a plurality of facets; thereby each of the facets for itself is respectively slightly convexly bulged, thus out of the remaining reflection surface 4.

The reflection surface 4 is formed by a dichroic reflecting layer applied to a provided housing part 5 made of glass. At the same time this housing part 5 forms an external surface 6 of the illuminant 1. In a side view to the illuminant 1 the dichroic reflecting layer is visible through the glass; a less portion of the light which is incident to the reflection surface 4, however not reflected on it, but transmitted shimmers through. The reflected and thereby bundled portion of the light having then a main propagation direction 7 can be used for spot lighting.

Figure 3A:
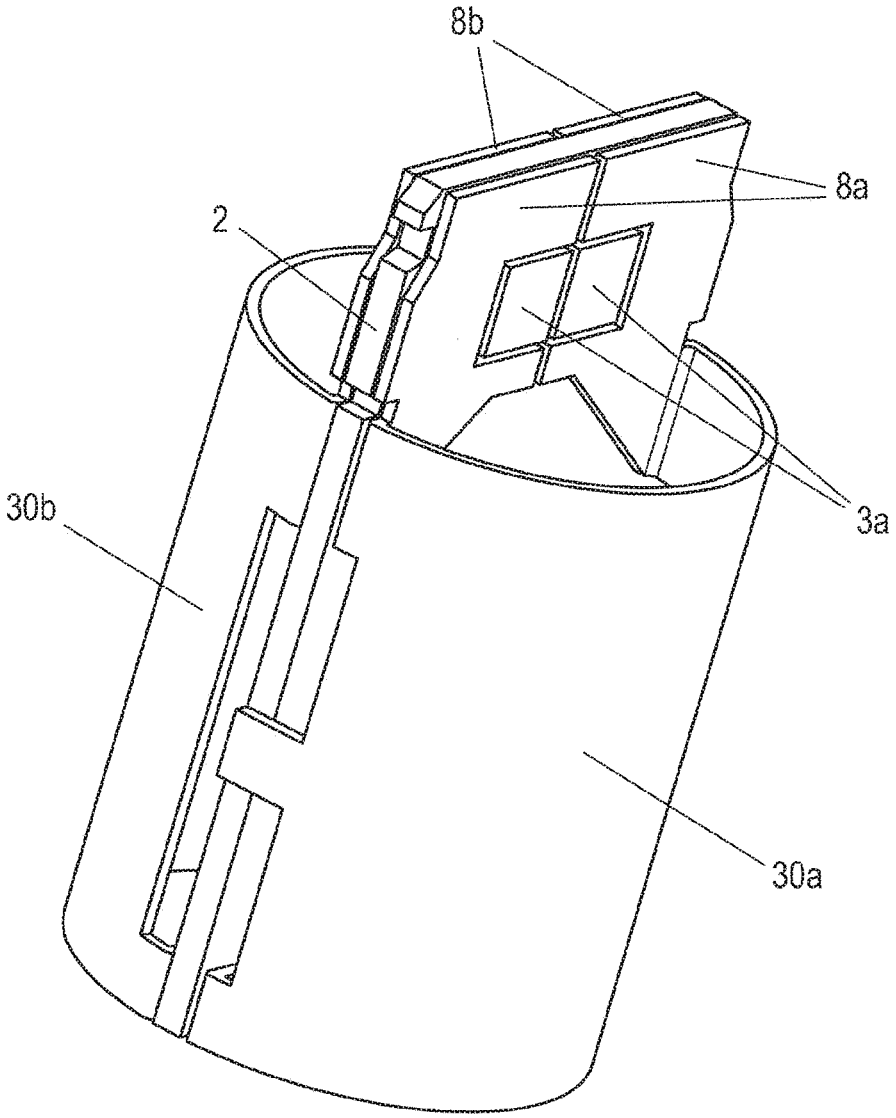

On both sides springs 8*a, b* of a cooling element placed at the support plate 2 abut against the support plate 2, c.f. also in detail the FIGS. 3*a, b*. Furthermore in the oblique view according to FIG. 1*a*, a transverse reflector 9 placed at the support plate 2 can be seen which on the one hand covers a cavity (c.f. FIG. 1*c*) and on the other reflects a portion of the light forward emitted by the LEDs 3 backwards.

Figure 1B:
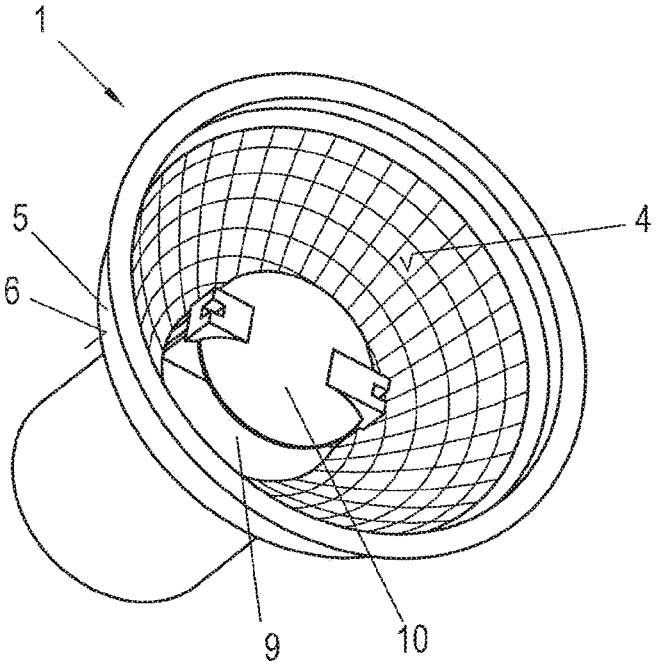
Figure 1C:
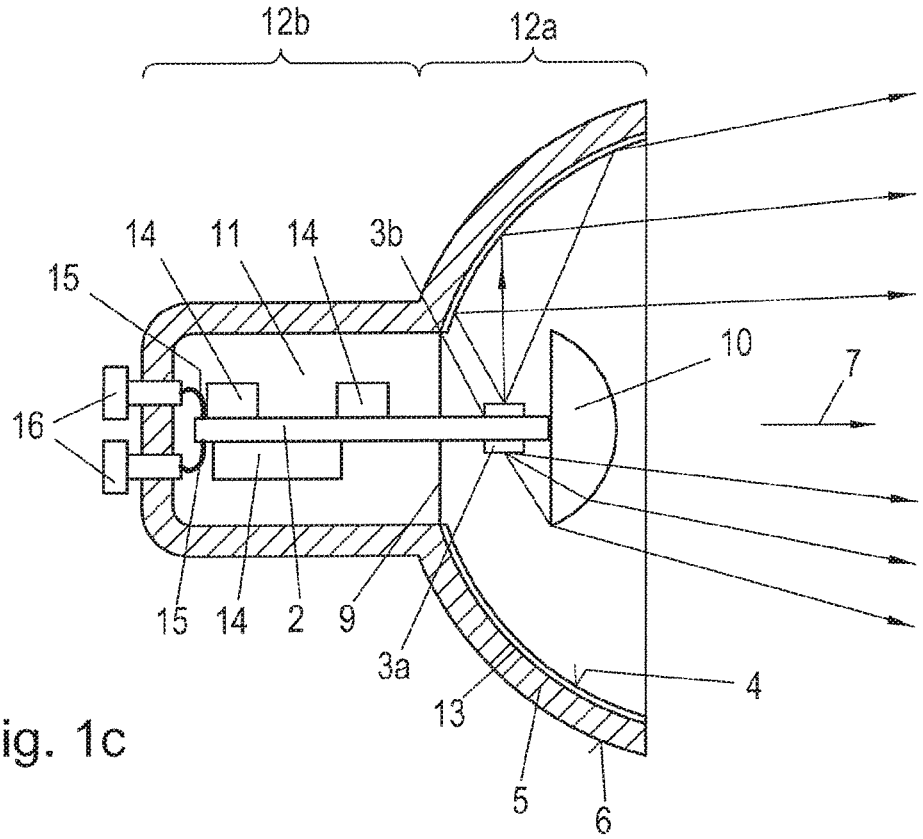

FIG. 1*b* shows the illuminant 1 according to FIG. 1*a* in addition with an optical body 10 placed at the support plate 2. Generally, an illuminant 1 is also conceivable without such an optical body 10, for example if an opaque covering disc is placed at the front edge of the reflection surface (not shown in the Figures). However, an optical body 10 is preferably provided, and the FIGS. 1*a, b* can insofar illustrate different assembling steps.

FIG. 1*c* shows a schematic cross section through the illuminant 1 according to FIG. 1*b*, wherein the sectional plane includes the optical axis of the reflection surface 4. A first portion of the light emitted by the LEDs 3 is incident to the reflection surface 4 and bundled along the main propagation direction 7. A second portion of the light passing the reflection surface 4 without reflection permeates the optical body 10 and is bundled by that. The optical body 10 acts as a convex or converging lens, namely diffracts the light permeating it into a target solid angle region including all directions deviating from the main propagation direction 7 by not more than 45°. More light is proportionally bundled with the optical body 10.

Another, not-illustrated portion of the light emitted by the LEDs 3 is emitted backwards, thus to the left in FIG. 1*c*, and is incident to the transverse reflector 9. The transverse reflector 9 then reflects it forwards, and at least a portion of this light also permeates the optical body 10. Furthermore the transverse reflector 9 also covers the cavity 11 disposed in a rear portion 12*b* of the housing part 5. The rear portion 12*b* adjoins the front portion 12*a* of the housing part 5, supporting the reflecting layer 13, backwards.

Together with the LEDs 3, driver electronics 14 are also arranged on the support plate 2, namely on a rear portion of the support plate 2. This rear portion of the support plate 2 is placed in the cavity 11 and covered forward by the transverse reflector 9. The conducting path structure (not illustrated) of the support plate 2 configured as a circuit board is connected to the base connection 16, in this case a GU 10 base, by means of soldered wires 15.

Figure 2:
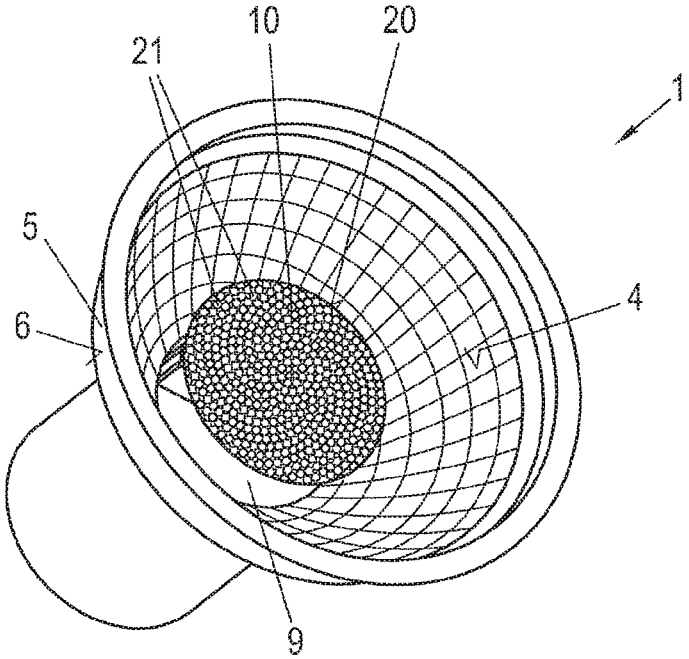

FIG. 2 shows another illuminant 1 according to the invention differing from that according to FIG. 1*b* by the optical body placed at the support plate 2. Although in the present case the optical body 10 in total is also formed as a planar convex lens, however a plurality of micro lenses 21 is formed into the light emitting surface 20 as light mixing means. The light permeating the optical body 10 of the illuminant 1 according to FIG. 2 is thus subdivided into a plurality of sub-beam bundles, which are respectively widened to some extent and thereby superimposed. In consequence a light mixing occurs. The micro lenses 21 are distributed over the light emitting surface 20 according to a Fibonacci pattern.

FIG. 3*a* shows the support plate 2 with the LEDs 3, which is then inserted into the housing part 5, in further details. Here in particular, a cooling element 30 is perceivable, at which the springs 8*a, b* abutting against the support plate 2 on both sides are formed. The cooling element 30 is composed of two cooling element parts 30*a, b*, which together enclose the support plate 2.

Figure 3B:
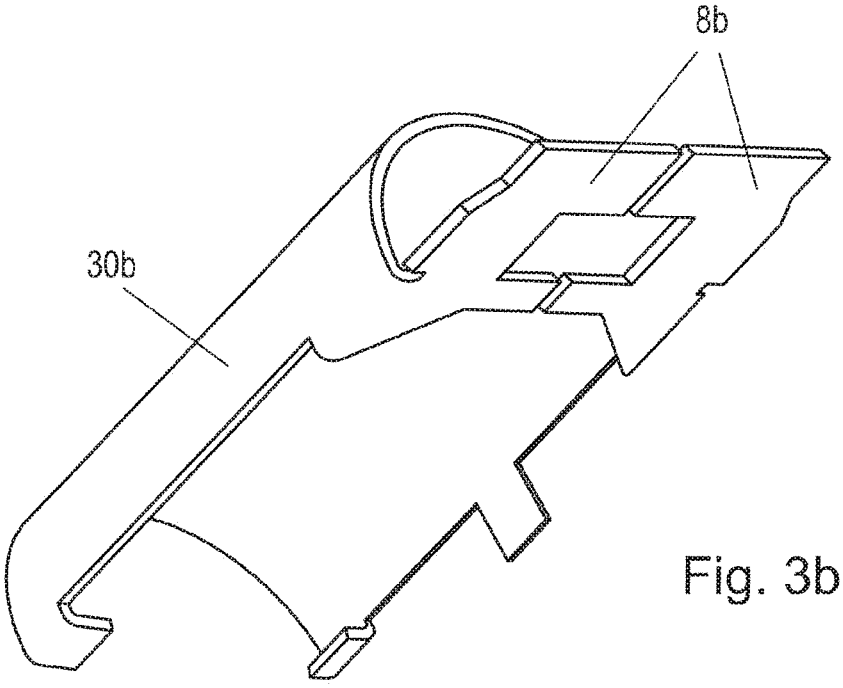

The two cooling element parts 30*a, b* are a punched part each; FIG. 3*b* illustrates one of them viewed singly. The base form is punched out of a metal sheet and then transformed into the illustrated three-dimensional shape by bending. The two cooling element parts 30*a, b* are assembled around the support plate 2 and then abut against one of the two sides of the support plate 2 by means of two springs 8*a, b* each. As an alternative to a mere abutment, for example a self-adhesive intermediate material (TIM) for thermal connection can also be provided.

The springs 8*a, b* form a front portion of the cooling element 30; its rear portion shaped as a hollow cylinder is then inserted into the cavity 11 in the housing part 5 together with the support plate 2 (c.f. FIG. 1*c* for illustration). The hollow-cylindrical portion of the cooling element 30 has a small oversize and is thus then held in the cavity 11 in a friction-locked manner. The exterior wall of the hollow-cylindrical portion extensively abuts against an internal wall of the housing part 5 confining the cavity 11, which ensures a good thermal connection.

Figure 4:
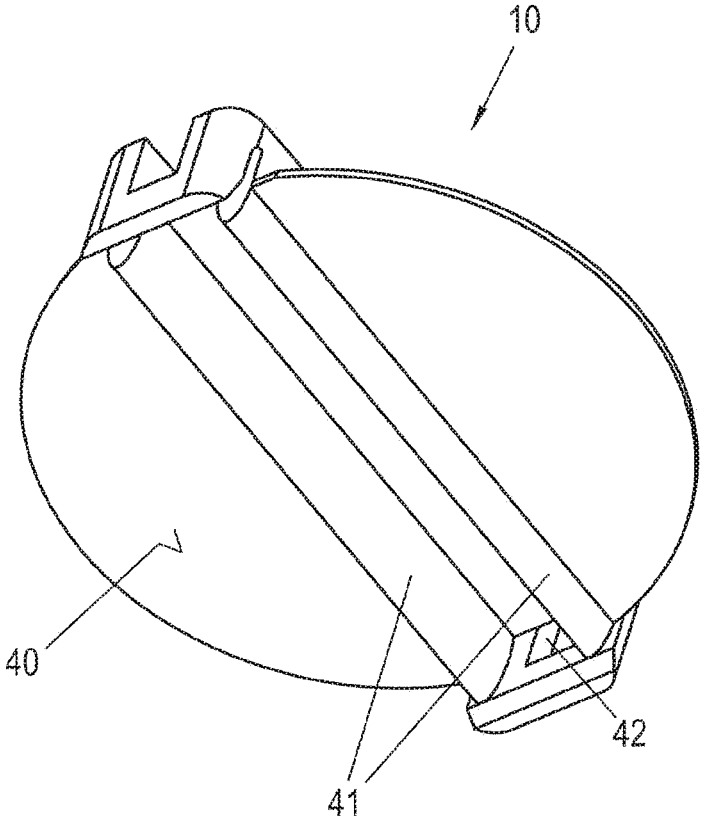
FIG. 4 shows an optical body for an illuminant according to the FIGS. 1, 2 in an oblique rear view.

FIG. 4 shows an optical body 10 seen from below, thus seen from behind, facing the light ingress surface 40. At this light ingress surface 40 two bars 41 extending parallel to each other across the light ingress surface 40 are formed out of the optical body material (here polycarbonate). Two recesses 42 serving for interlocking the optical body 10 to the support plate 2 can furthermore be seen at the edge side of the light ingress surface 40. For this purpose the side parts of the optical body 10, in which one of the recesses 42 each is provided, are separated from the remaining optical body 10 partially by a respective slot. Thus, the side parts can temporarily flex outwards when the optical body 10 is slid on, before the optical body 10 clicks into its interlocked fit.

Figure 5:
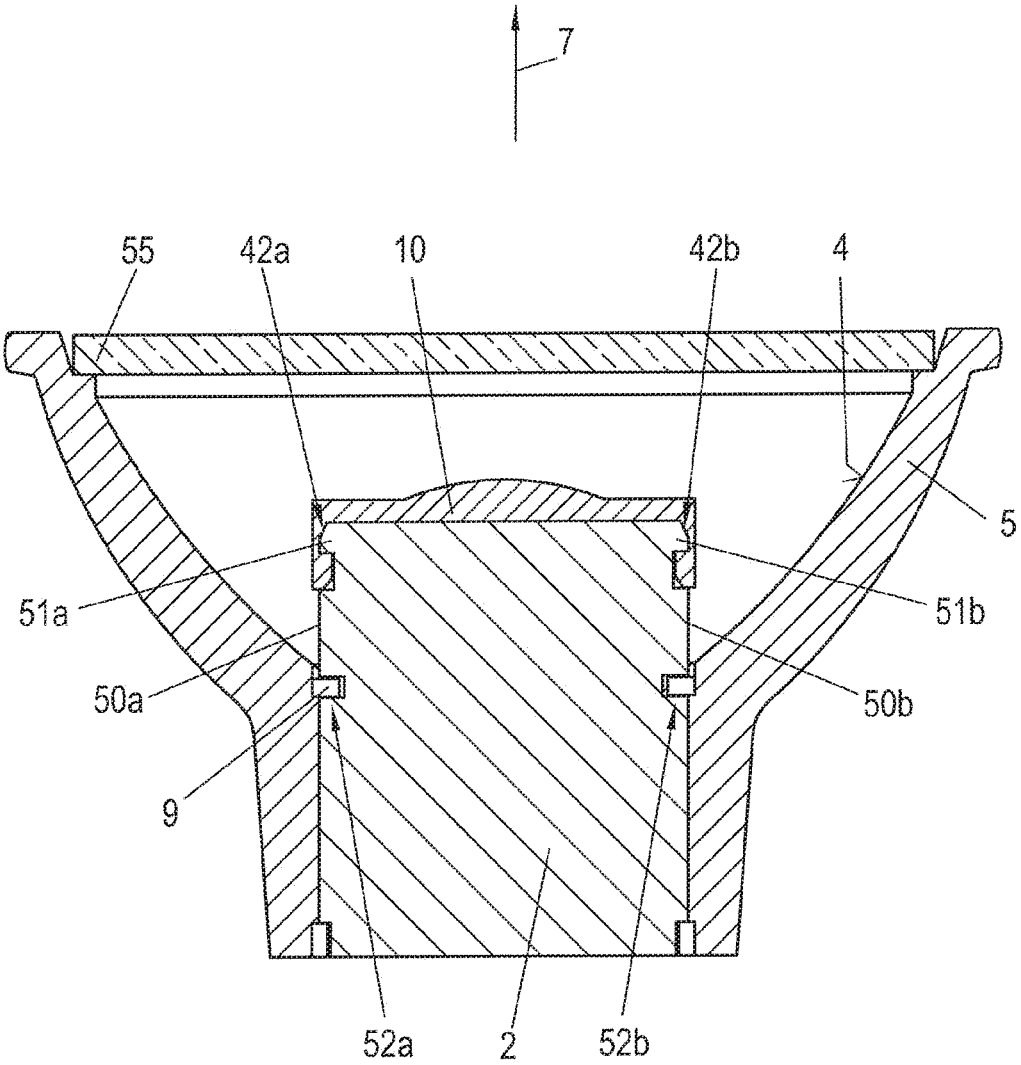
FIG. 5 shows a cross section through an illuminant with an arrangement of support plate and cooling element according to FIG. 3*a* and an optical body according to FIG. 4.

The cross section according to FIG. 5 including the optical axis of the reflector illustrates the optical body 10 placed at the support plate 2 (together with the cooling element, not visible in cross section) in its interlocked fit. At two edge surfaces 50*a, b* of the support plate 2, extending along the main propagation direction 7 one projection 51*a, b* each is provided at the front end engaging the respectively associated recess 42*a, b* in the optical body 10. In this interlocked fit the bars 41 then also press the springs 8*a*, 8*b* of the cooling element 30 onto the support plate 2 (cf. the FIGS. 3*a* and 4 in overall view).

Furthermore in FIG. 5 the assembly of the transverse reflector 9 to the support plate 2 can be seen, for this purpose the latter comprises a groove 52*a, b* at both its edge surfaces 50*a, b*, respectively. The transverse reflector 9 is slotted corresponding to the width of the support plate 2 remaining in consideration of the grooves 52*a, b*, wherein this slot is centrally placed in the transverse reflector 9. One of the bars adjoining the slot and remaining at the edge of the transverse reflector 9 is disconnected, so that the transverse reflector 9 can be flipped open and placed onto the support plate 2. In FIG. 5 the bars of the transverse reflector 9 then resting in the grooves 52*a, b* can be seen.

Finally, in FIG. 5 a covering disc 55 closing the concave mirror formed by the reflection surface can also be seen. In the present case it is clearly, thus transparently, configured.

The invention claimed is:

1. An illuminant comprising:

a first LED and a second LED for emitting light;

a planar support plate on which the LEDs are mounted such that the first LED is mounted on a first side of the support plate and the second LED is mounted on a second side of the support plate opposite thereto in relation to a thickness direction of the support plate;

a reflection surface shaped as a concave mirror, in which concave mirror the LEDs mounted on the support plate are arranged so that in operation at least a portion of the light emitted therefrom is reflected by the reflection surface and thereby bundled with a main propagation direction;

a base connection to which the LEDs are connected in an electrically operable manner for electrically contacting the illuminant from outside; and a cooling element disposed between and in direct thermal contact with the support plate and the housing part, in which the cooling element contacts the first side but not the second side of the support plate with a first spring and contacts the second side but not the first side of the support plate with a second spring, and in which the support plate is held between the first and second springs in a friction-locked manner;

wherein a direction of one surface of the support plate is aligned along the main propagation direction; and wherein a housing part of the illuminant made of a transparent housing material is provided, which housing part at the same time forms an external surface of the illuminant, the external surface flanking the main propagation direction and supporting a reflecting layer which forms the reflection surface at an internal surface opposite to the external surface.

2. The illuminant according to claim 1, in which at least one of the housing material is glass and the reflecting layer is a dichroic layer.

3. The illuminant according to claim 1, in which the support plate is a circuit board with a conducting path structure, to which the LEDs are electrically conductively connected, wherein in addition to the LEDs at least parts of a driver electronics for operating the LEDs are also mounted on the circuit board and are electrically conductively connected to the conducting path structure.

4. The illuminant according to claim 1, in which the support plate comprises a metal layer with an area of at least 20 $mm^2$ for heat spreading.

5. The illuminant according to claim 1, in which the cooling element has a thermal resistance of at most 45 K/W, taking contact resistances into account.

6. The illuminant according to claim 5, in which the cooling element is composed of at least two parts, which cooling element parts together enclose the support plate in relation to a revolution around the main propagation direction.

7. The illuminant according to claim 5, in which an in relation to the main propagation direction, a rear portion of the housing part opposite to a portion of the housing part, supporting the reflecting layer, circumferentially confines a cavity, into which the cooling element is inserted and held therein in a friction-locked manner.

8. A method for producing the illuminant according to claim 7, in which at first the cooling element is mounted to the support plate and then the cooling element is inserted into the cavity together with the support plate.

9. The illuminant according to claim 1, in which an optical body of a transparent optical body material is placed at a front end of the support plate in relation to the main propagation direction, at least a portion of the light emitted from the LEDs permeating the optical body without reflection.

10. The illuminant according to claim 9, in which the optical body acts as a converging lens and diffracts at least a portion of the light permeating the optical body into a target solid angle region, which target solid angle region includes all directions tilted with respect to the main propagation direction by not more than 45°.

11. The illuminant according to claim 9, in which the optical body comprises a light mixing means comprising a micro lens arrangement.

12. The illuminant according to claim 9, in which the optical body is interlocked with at least one of the support plate and the cooling element.

13. The illuminant according to claim 12, in which the optical body in its interlocked fit presses the first and second springs of the cooling element in their abutment against the support plate.

14. The illuminant according to claim 1, comprising a transverse reflector placed at the support plate and extending transversely to the main propagation direction.

15. The illuminant according to claim 1, in which the first spring comprises two springs arranged beside one another and in contact with the first side of the support plate, and in which the second spring comprises an additional two springs arranged beside one another and in contact with the second side of the support plate.

16. The illuminant according to claim 1, in which at least one of the first spring and the second spring is formed as a unitary piece with the cooling element.

17. The illuminant according to claim 1, further comprising a thermal intermediate material disposed between the support plate and at least one of the first spring and the second spring.

18. The illuminant according to claim 1, in which a front portion of the cooling element is formed by the first and second springs, and in which a rear portion of the cooling element is shaped as a hollow cylinder.

19. The illuminant according to claim 1, in which the first LED occupies an interior region of the first spring, and in which the second LED occupies an interior region of the second spring.

20. An illuminant comprising:

a first LED and a second LED for emitting light;

a planar support plate on which the LEDs are mounted;

a reflection surface shaped as a concave mirror, in which concave mirror the LEDs mounted on the support plate are arranged so that in operation at least a portion of the light emitted therefrom is reflected by the reflection surface and thereby bundled with a main propagation direction;

a base connection to which the LEDs are connected in an electrically operable manner for electrically contacting the illuminant from outside;

wherein a direction of one surface of the support plate is aligned along the main propagation direction;

wherein the first LED is mounted on a first side of the support plate and the second LED is mounted on a second side of the support plate opposite thereto in relation to a thickness direction of the support plate;

wherein a housing part of the illuminant made of a transparent housing material is provided, which housing part at the same time forms an external surface of the illuminant, the external surface flanking the main propagation direction and supporting a reflecting layer which forms the reflection surface at an internal surface opposite to the external surface;

wherein an optical body of a transparent optical body material is placed at a front end of the support plate in relation to the main propagation direction, at least a portion of the light emitted from the LEDs permeating the optical body without reflection;

wherein the optical body is interlocked with at least one of the support plate and the cooling element; and wherein the optical body in its interlocked fit presses the springs of the cooling element in their abutment against the support plate.

* * * * *